United States Patent [19]

Bond et al.

[11] Patent Number: 4,962,810

[45] Date of Patent: Oct. 16, 1990

[54] HEAT EXCHANGER

[75] Inventors: William H. Bond, Del Mar; Alex C. Yi, Cerritos, both of Calif.

[73] Assignee: Rockwell International Corporation, El Segundo, Calif.

[21] Appl. No.: 408,965

[22] Filed: Sep. 18, 1989

[51] Int. Cl.[5] ..... F28F 9/26

[52] U.S. Cl. ..... 165/143; 165/145

[58] Field of Search ..... 165/143, 145

[56] References Cited

U.S. PATENT DOCUMENTS

| | | | |
|---|---|---|---|
| 2,002,763 | 5/1935 | Bair | 165/144 |
| 2,327,491 | 8/1943 | Blais | 165/144 |
| 2,487,626 | 11/1949 | Wittman | 165/79 |
| 3,180,406 | 4/1965 | Oechslin | 165/144 |
| 4,396,002 | 8/1983 | Lipets | 165/143 |
| 4,501,320 | 2/1985 | Lipets et al. | 165/144 |
| 4,559,996 | 12/1985 | Andrieux | 165/76 |

*Primary Examiner*—John Rivell
*Assistant Examiner*—L. R. Leo
*Attorney, Agent, or Firm*—Charles T. Silberberg; Max Geldin

[57] ABSTRACT

A multipass heat exchanger comprising an arrangement of a plurality of heat exchanger modules, each module having a plurality of passes for passage of a first heat exchange fluid and a plurality of tubes across such passes for passage of a second heat exchange fluid. The heat exchanger modules are disposed in side-by-side relation, with each successive module adjoining the previous module in a stepped relation, the second exchanger module being positioned relative to the first module so that the first heat exchanger fluid leaving the first pass of the first heat exchanger module enters directly the second pass of the second module, and so on, in a straight through fashion, for as many passes as desired. The result is a highly efficient multipass heat exchanger of minimum weight and pressure loss in the flow path on the shell side of the exchanger, comprised of multiple heat exchanger units, with no reversal of flow in each pass in each exchanger unit.

12 Claims, 2 Drawing Sheets

FIG. 1a
PRIOR ART
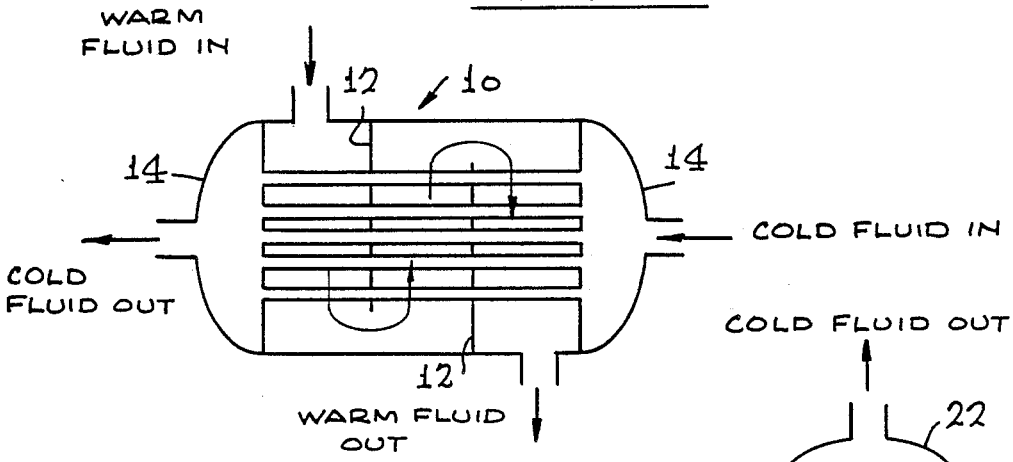
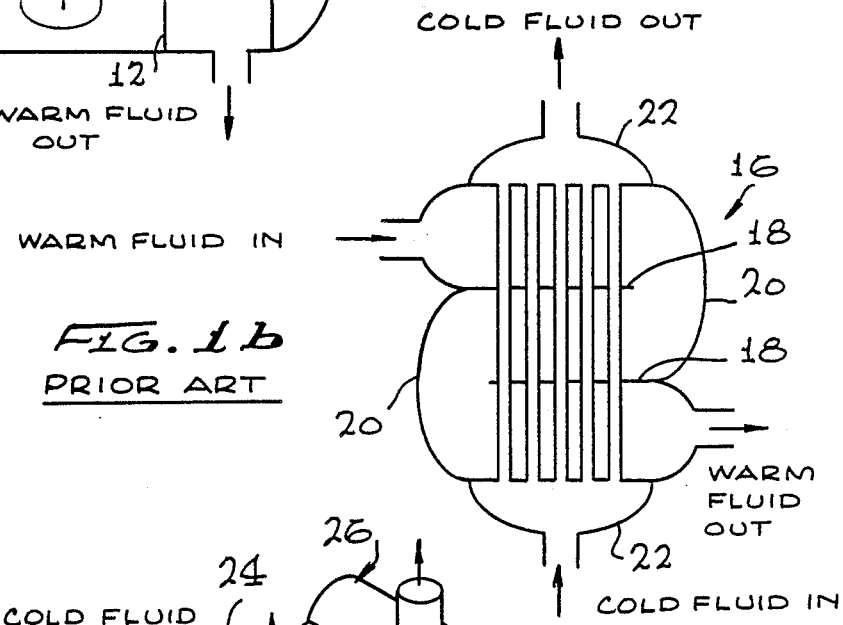
FIG. 1b
PRIOR ART
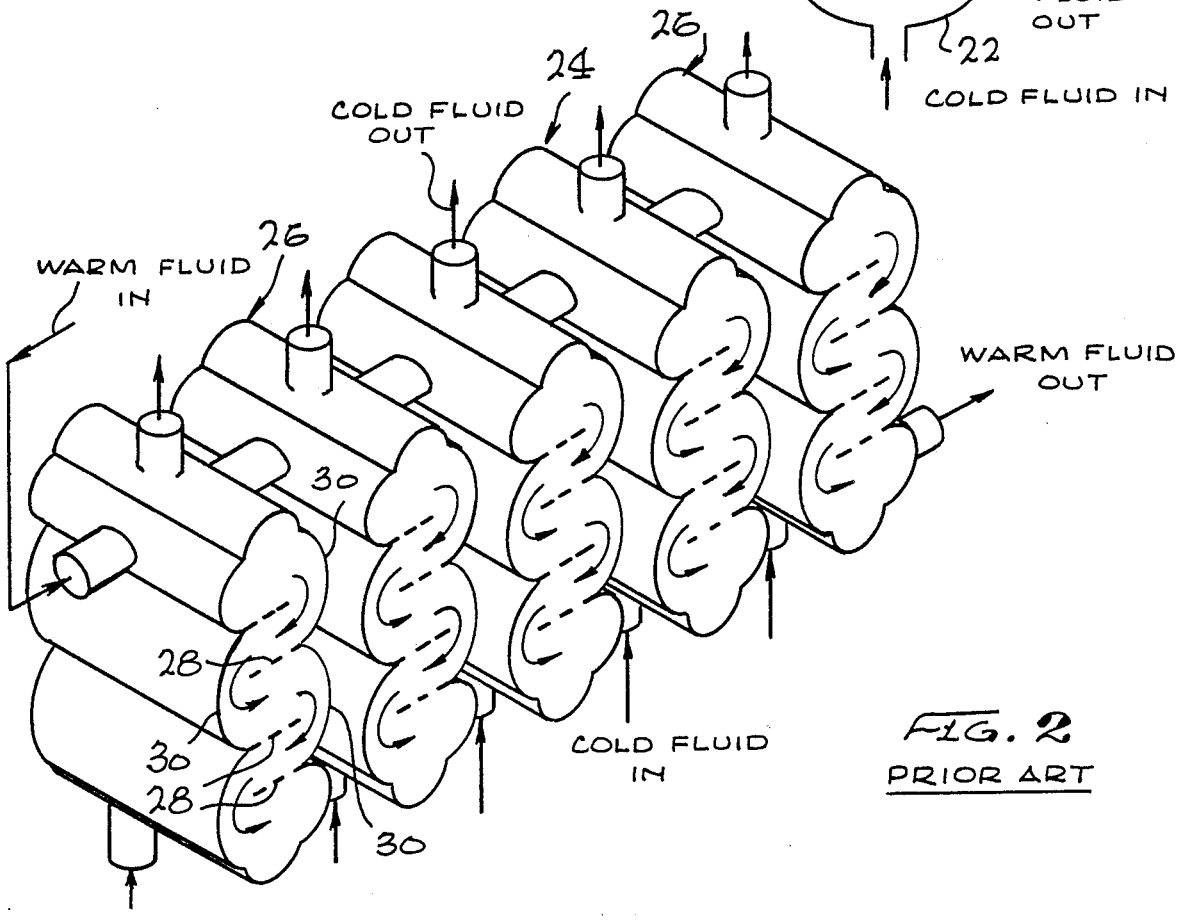
FIG. 2
PRIOR ART

HEAT EXCHANGER

BACKGROUND OF THE INVENTION

This invention relates to an improved heat exchanger, and is particularly concerned with a multipass heat exchanger wherein the flow path on the shell side of the heat exchanger is designed to achieve minimum weight of the heat exchanger and minimum pressure loss.

This invention was made with Government support under Contract No. NAS3-25559 awarded by the United States Air Force. The Government has certain rights in this invention.

To approach maximum effectiveness, shell and tube heat exchangers often employ many passes of the shell side fluid across the tube bank in a cross-counterflow arrangement. FIGS. 1*a* and 1*b* of the drawings show two conventional design approaches. FIG. 1*a* shows a conventional 3 pass cross-counterflow shell and tube heat exchanger 10 employing a pair of baffles 12 and a pair of end headers 14. FIG. 1*b* is also a conventional design of heat exchanger 16 using multiple baffles 18 and multiple shell side warm fluid headers 20 to reverse shell side flow, together with end headers 22.

As illustrated in FIG. 2, where large capacity at maximum performance is desired, a design arrangement 24 is conventionally used comprised of a number of parallel exchanger units 26, each of a type similar to FIG. 1*b*, and having a plurality of baffles 28 and a plurality of shell side headers 30 for flow reversal. It is noted that a large total number of hot fluid headers and of flow reversals is embodied in this arrangement.

Maximum performance is indicated by high transfer of heat per unit volume with small pressure loss and a low temperature difference driving the heat transfer. A measure of the weight efficiency of the design is the "wrap factor", defined as the weight of the shell and baffles, compared with the weight of the heat transfer tubes. Light weight designs are characterized by low values of this ratio or wrap factor, and are of importance in aerospace applications.

U.S. Pat. No. 4,501,320 to Lipets, et al discloses a multiflow tubular air heater employing a two-pass heat exchange concept embodying a Z-type bypass conduit. Other illustrative prior art heat exchangers are disclosed in U.S. Pat. Nos. 2,002,763; 2,327,491; 2,487,626; 3,180,406; and 4,559,996.

It is accordingly an object of the present invention to provide a shell and tube heat exchanger having minimum weight and minimum pressure loss.

Another object is to minimize the header weight, or wrap factor, of a system of parallel multipass exchangers of the type shown in FIG. 2, and to reduce the pressure loss of the fluid flowing across the outside of the tubes.

A further object is the provision of an arrangement of multiple exchangers wherein there is no flow reversal and hence no flow reversal headers, and the shell side fluid passes through the exchangers in a straight through fashion, with minimum pressure loss.

SUMMARY OF THE INVENTION

The above objects and advantages are achieved, according to the invention by the provision of an arrangement of multiple heat exchangers or heat exchanger modules, each having a plurality of passes, with each successive exchanger adjoining the previous one in a stepped fashion, and providing straight through flow of a first heat exchange fluid from one pass of one exchanger to a successive pass in the succeeding exchanger, in heat exchange relation with a second heat exchange fluid in tubes positioned across the passes of each exchanger. In this arrangement or system, no flow reversal takes place for the first fluid through the successive heat exchange passes, and no additional header is required and no additional pressure loss occurs on going from one pass to a succeeding one.

In the stepped arrangement of the heat exchangers according to the invention, the second exchanger is positioned relative to the first so that, for example, the warm fluid leaving the first pass of the first exchanger enters directly the second pass of the second exchanger, and the warm fluid leaving the second pass of the second exchanger enters directly the third pass of the third exchanger, and so on for as many passes as desired, usually corresponding to the total number of passes in each heat exchanger.

At each end of the arrangement of heat exchangers, where there are insufficient heat exchangers or heat exchanger modules to complete the number of passes required, fluid exhausted from the last pass or passes of heat exchanger modules at the top rear end of the assembly, is introduced into corresponding heat exchanger modules at the bottom front end of the arrangement. In this manner there are sufficient passes corresponding to the total number of passes in each module, for every warm fluid path and at the proper location on the cold fluid side of the exchanger, as pointed out in detail hereinafter.

The result is a highly efficient multipass heat exchanger of minimum weight and pressure loss in the flow path on the shell side of the exchanger, comprised of multiple heat exchanger units, with no reversal of flow in each pass in each exchanger unit, and hence eliminating the need for side headers such as 20 and 30 in FIGS. 1*b* and 2.

BRIEF DESCRIPTION OF THE DRAWINGS

FIG. 1*a* illustrates a conventional 3 pass cross-counterflow shell and tube heat exchanger;

FIG. 1*b* illustrates a conventional heat exchanger showing multiple baffles and multiple shell side fluid headers to reverse shell side flow;

FIG. 2 illustrates a conventional heat exchanger having large capacity formed of multiple heat exchanger units in parallel, each of a type similar to the heat exchanger of FIG. 1*b;*

DETAILED DESCRIPTION OF THE INVENTION AND PREFERRED EMBODIMENTS

Figure 3:
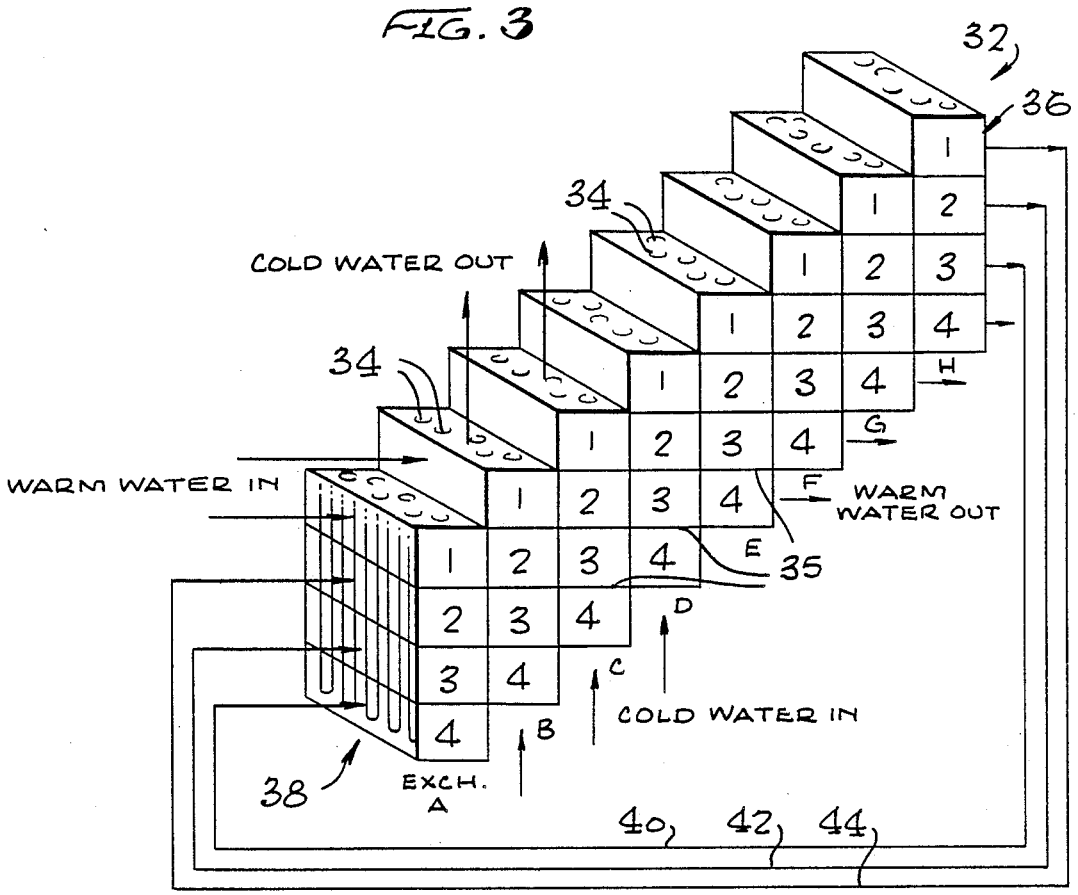
FIG. 3 illustrates schematically a multiple heat exchanger arrangement in stepped fashion according to the invention.
Figure 4:
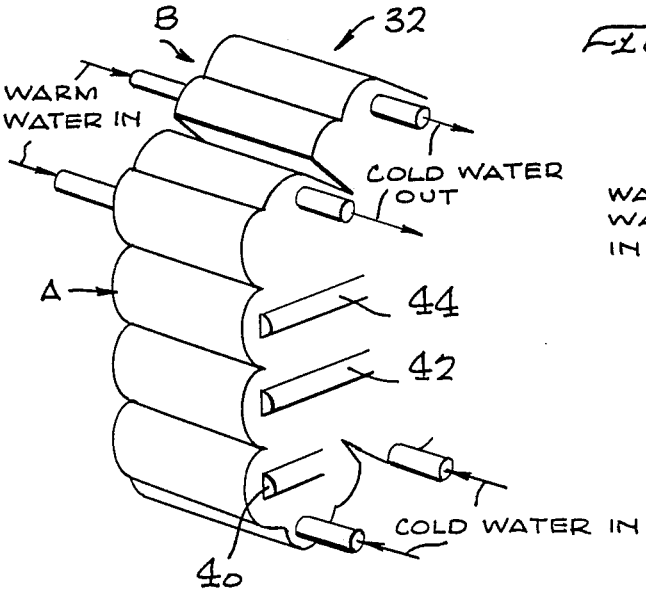
FIG. 4 is an isometric view showing the structure of the first two heat exchanger modules of the heat exchanger arrangement of FIG. 3.
Figure 5:
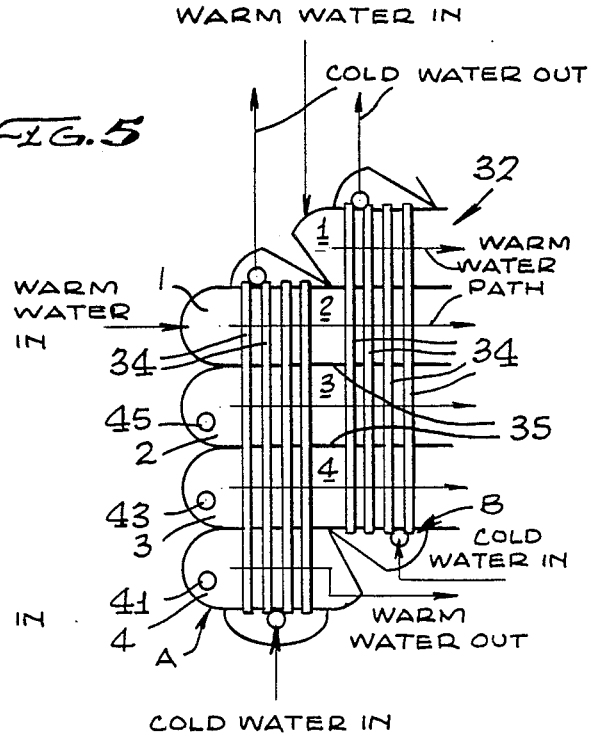
FIG. 5 is an elevational front section of the structure shown in FIG. 4.

Referring to FIGS. 3 to 5 of the drawing, numeral 32 illustrates a multiple heat exchanger arrangement according to the invention. The heat exchanger of this embodiment comprises an ensemble of 8 exchanger modules A, B, C, D, E, F, G and H, in side-by-side interconnected relation, with 4 parallel passes numbered 1, 2, 3 and 4 in vertically spaced relation in each exchanger module, for passage of warm fluid, e.g. warm water, and a plurality of vertical tubes 34 passing completely through each exchanger module, for passage of cold fluid, e.g. cold water. Baffles 35 are provided between the parallel passes of each module to prevent cross-mixing of warm fluid flow. The structure of the first two modules A and B is shown more clearly in FIGS. 4 and 5.

Each successive heat exchanger module B, C, D, E, F, G and H adjoins the previous module in a stepped relation, so that warm water discharging from pass #1 of module A passes horizontally, that is, straight through pass #2 of module B, pass #3 of module C and pass #4 of module D, in heat exchange relation with the cold water in tubes 34 disposed across each pass. Similarly for adjacent modules B, C, D and E there are 4 straight through passes for warm water from pass #1 of module B, through passes #2, #3 and #4 of modules C, D and E; from pass #1 of module C, through passes #2, #3 and #4 of modules D, E and F; from pass #1 of module D, through passes #2, #3 and #4 of modules E, F and G; and from pass #1 of module E, through passes #2, #3 and #4 of modules F, G and H.

At the top rear end 36 and the bottom front end 38 of the ensemble of modules 32 there are insufficient heat exchanger modules to complete 4 passes for passage of the warm water. Thus, there are only 3 passes #1, #2 and #3 through modules F, G and H; only 2 passes #1 and #2 through modules G and H, and only one pass #1 through module H.

This condition is solved by directing and returning warm water where it exhausts from pass #3 of the last module H, via line 40 to the inlet 41 of pass #4 of the corresponding module A to complete 4 passes. Similarly the warm water exhaust from pass #2 of module H is exhausted via line 42 to the inlet 43 of pass #3 of the module A to complete 4 passes via pass #3 of module A and pass #4 of module B, and the warm water exhaust from pass #1 of module H is exhausted via line 44 to the inlet 45 of pass #2 of module A, to complete 4 passes via pass #2 of module A, pass #3 of module B and pass #4 of module C.

Thus, in this embodiment, eight streams of warm water are each passed straight through four successive passes in four different modules, in heat exchange relation with the cold water in the tubes 34 passing transversely through the passes of each module. This invention concept eliminates the side headers 20 and 30 to reverse shell side flow, of the prior art exchangers of FIGS. 1*b* and 2. The result is a substantial reduction in weight and pressure loss afforded by the multipass heat exchanger concept of the present invention such as the embodiment of FIGS. 3 to 5, over the prior art multipass heat exchangers, for the same number of passes of shell side flow. These features of the invention concept are important in the performance of an aerospaceplane propulsion system.

It will be understood that various modifications can be made in the invention heat exchanger within the state of the art. Thus, for example, the number of stepped contiguous heat exchanger modules and the total number of passes for each shell side fluid flow stream per module can be varied as desired. In preferred practice there are at least three successive stepped heat exchanger modules, each containing at least three parallel passes for shell side fluid flow.

From the foregoing it is seen that the invention provides a system of parallel multipass heat exchangers affording straight through passage of shell side heat exchanger fluid to minimize header weight, and to reduce pressure loss of the fluid flowing across the outside of the tubes.

Since various further modifications of the invention will occur to those skilled in the art, the invention is not to be taken as limited except by the scope of the appended claims.

What is claimed is:

1. A multipass heat exchanger which comprises:

a plurality of successive exchanger modules starting from a first module to a last module, each module having a plurality of individually successively numbered parallel passes starting with a first pass, for passage of a first heat exchange fluid and a plurality of tubes disposed transversely of said passes for passage of a second heat exchanger fluid, said modules being connected in side-by-side staggered relation with each successive module adjoining the previous module in a stepped relation such that the first pass of a first module is connected to the second pass of a second module, so that the first heat exchanger fluid leaving the first pass of the first heat exchanger module enters directly the second pass of the second module, and continuing on in the same manner for any successive modules in a straight-through fashion, for as many passes as desired.

2. The heat exchanger of claim 1, and where at each end of the arrangement of stepped heat exchanger modules, there are insufficient modules to complete the total number of said passes required, means is provided for transferring said first fluid where it exhausts from a pass at the discharge end of the last heat exchanger module to an inlet end of a pass in the first heat exchanger module, to complete the desired number of passes for said first heat exchange fluid.

3. The heat exchanger of claim 1, wherein said plurality of passes of each module are disposed one above the other, such as to provide an arrangement of stepped heat exchanger modules having a lower front end and an upper rear end, and said plurality of tubes in each said module are disposed normal to each of said passes, from one end of said module to the opposite end thereof.

4. The heat exchanger of claim 3, and where at the upper rear end and lower front end of the arrangement of stepped heat exchanger modules, there are insufficient modules to complete the total number of passes corresponding to the total number of passes for each module, ducting means is included for ducting said first fluid where it exhausts from a pass at the discharge end of the last heat exchanger module at the upper rear end of said arrangement, to an inlet end of a pass of the first heat exchanger module at the lower front end of said arrangement, to complete the desired number of passes for the first heat exchanger fluid corresponding to the number of passes in each module.

5. The heat exchanger of claim 1, said exchanger modules each containing four parallel passes, and said heat exchanger containing eight of said exchanger modules, to provide a multiplicity of four straight through heat exchange flow passes for the first heat exchanger fluid.

6. The heat exchanger of claim 4, said exchanger modules each containing four parallel passes, and said heat exchanger containing eight of said exchanger modules, to provide a multiplicity of four straight through heat exchange flow passes for the first heat exchanger fluid.

7. The heat exchanger of claim 6, the upper rear end of the arrangement of stepped heat exchanger modules only providing from 1 to 3 passes for said first fluid, and the lower front end of the arrangement also only providing from 1 to 3 passes for said first fluid, said ducting means connecting the discharge ends of the last heat exchanger module at said upper rear end of said arrangement with the corresponding inlet ends of the first heat exchanger module at said lower front end of the arrangement, to complete a multiplicity of four passes for the first heat exchanger fluid throughout the entire arrangement of modules.

8. In a multipass heat exchanger, a plurality of successive heat exchanger units from a first heat exchanger unit to a last heat exchanger unit, each having a plurality of parallel passes arranged one above the other for passage of a first heat exchanger fluid, and a plurality of tubes positioned across said passes for passage of a second heat exchanger fluid, said units being joined together in contiguous side-by-side relation, successive units adjoining the previous unit in a stepped fashion, to form a plurality of paths of straight-through flow for said first fluid, said heat exchanger being free of side headers for flow reversal of said first fluid.

9. The heat exchanger of claim 8, including ducting means for exhausting first fluid from some of the passes in the last heat exchanger unit to the inlets of some of the passes in the first heat exchanger unit.

10. The heat exchanger of claim 9, said exchanger units each containing four parallel passes, and said heat exchanger containing eight of said exchanger units, to provide a multiplicity of four straight through heat exchange flow passes for the first heat exchanger fluid.

11. A multipass heat exchanger which comprises:

a plurality of at least three exchanger modules, each module having a plurality of at least three parallel passes for passage of a first heat exchange fluid and a plurality of tubes disposed transversely of said passes for passage of a second heat exchange fluid, said modules being connected in side-by-side relation with each successive module adjoining the previous module in a stepped relation, such that the first pass of a first module is connected to the second pass of a second module, so that the first heat exchanger fluid leaving the first pass of the first heat exchanger module enters directly the second pass of the second module, and the first fluid discharged from the second pass of the second module enters directly the third pass of the third module, and continuing on in the same manner for any successive modules in a straight-through fashion for as many passes corresponding to the total number of passes in each module.

12. The heat exchanger of claim 8, including baffle means between the parallel passages of each heat exchanger unit to prevent cross-mixing of said first heat exchanger fluid.

* * * * *